United States Patent [19]

Suga et al.

[11] 4,031,699

[45] June 28, 1977

[54] PORT LINER ASSEMBLY

[75] Inventors: Yoshiyuki Suga, Tokyo; Tsutomu Kita, Kawasaki; Ryusuke Harada, Tokyo, all of Japan

[73] Assignee: Fuji Jukogyo Kabushiki Kaisha, Tokyo, Japan

[22] Filed: Aug. 20, 1975

[21] Appl. No.: 606,238

[30] Foreign Application Priority Data

Oct. 25, 1974 Japan ..... 49-129185

[52] U.S. Cl. ..... 60/282; 60/322; 123/191 A; 123/193 H

[51] Int. Cl.[2] ..... F01N 3/10

[58] Field of Search ..... 60/272, 282, 322; 123/191 A, 193 H, 41.85

[56] References Cited

UNITED STATES PATENTS

| | | | |
|---|---|---|---|
| 2,737,171 | 3/1956 | Torre | 123/41.85 |
| 3,413,803 | 12/1968 | Rosenlund | 60/282 |
| 3,577,727 | 5/1971 | Warren | 60/292 |
| 3,635,031 | 1/1972 | Haddad | 60/282 |
| 3,703,083 | 11/1972 | Tadokoro | 60/322 |
| 3,850,453 | 11/1974 | Bentley | 60/322 |
| 3,898,803 | 8/1975 | Sasaki | 60/282 |
| 3,902,853 | 9/1975 | Marsee | 60/322 |
| 3,916,850 | 11/1975 | Date | 60/322 |
| 3,940,927 | 3/1976 | Maurhoff | 60/322 |

FOREIGN PATENTS OR APPLICATIONS

| | | | |
|---|---|---|---|
| 777,411 | 2/1935 | France | 123/41.85 |
| 2,323,793 | 11/1974 | Germany | 60/282 |
| 473,472 | 10/1947 | United Kingdom | 123/191 A |

*Primary Examiner*—Douglas Hart
*Attorney, Agent, or Firm*—Martin A. Farber

[57] ABSTRACT

A port liner assembly comprises a tubular liner embedded in a cylinder head block as its moulding so as to be integrally formed into a heat-insulation wall surrounding an exhaust port formed in said cylinder head block, said tubular liner consisting of an outer tube and an inner tube spaced inside of said outer tube.

6 Claims, 13 Drawing Figures

PORT LINER ASSEMBLY

DETAILED DESCRIPTION OF THE INVENTION

The present invention relates to a port liner assembly used as a heat-insulation wall surrounding an exhaust port so as to maintain exhaust gasses in said exhaust port at a high temperature.

It has been well known in the internal combustion gasoline engine that exhaust gasses are burned once again out of cylinder in order to reduce noxious components such as carbon monoxide and hydrocarbon. In this case, water coolant for cooling the cylinder head unavoidably causes the temperature of the exhaust gasses in the exhaust port to be lowered, whereby the exhaust gasses out of cylinder are burned not sufficient to reduce the noxious components.

The prior heat-insulation system for an exhaust port includes a single tubular liner inserted into the exhaust port in a manner to be spaced from its inner wall. However, since the configuration of the exhaust port is too complicated to attach the liner to the port wall with a suitable clearance being maintained.

It seems to be available to form the heat-insulation wall in the exhaust port, that the single tubular liner together with a moulding core for forming the exhaust port is embedded in a cylinder head block as its moulding operation. Such case includes some problems that the port liner has no clearance to the port wall, and receives a thermal stress, a dynamic stress and so on generated by a thermal expansion caused due to the qualitative difference of the port liner and cylinder heat block and then the port liner is broken in use by a slight vibration or shock applied thereto.

An object of this invention is to provide an improved port liner assembly having two outer and inner tubes, said inner tube being rigidly supported in a place to said outer tube by a simple means.

Another object of this invention is to provide an improved port liner assembly having absorption sufficient to take a thermal stress, a dynamic stress and so on.

Third object of this invention is to provide an improved port liner assembly easily constituted in a double tubular liner, which extends to span all the exhaust area.

The other features and advantages of this invention will be understood from the following description with reference to the accompanying drawings as follows.

Figure 2:
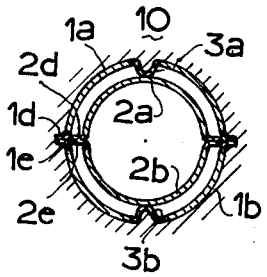
FIG. 2 is a cross-section of the cylinder head block of FIG. 1 along a line of A — A.
Figure 1:
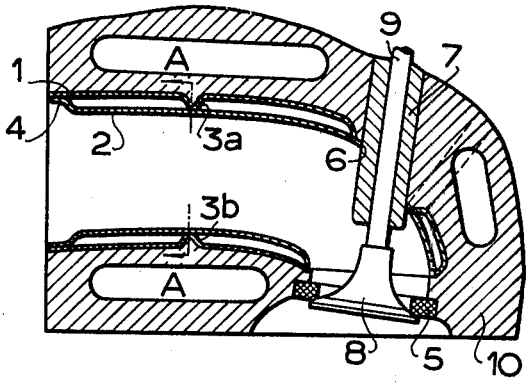
FIG. 1 is a vertical section of a cylinder head block including a port liner assembly of this invention.

FIGS. 1 and 2 indicates a heat insulation system including a port liner assembly embodying the present invention. The port liner assembly consists of two tubular outer and inner liners 1 and 2. The outer liner 1 is formed by two half shells 1*a* and 1*b* with two pairs of flanges 1*d* and 1*e* attached to each other by means of welding. The inner liner 2 is also formed by two half shells 2*a* and 2*b* with two pairs of flanges 2*d* and 2*e* attached to each other by means of welding. The outer liner shells 1*a* 1*b* have some beats 3*a* and 3*b* protruded inside thereof, so as to press the outer surface of the inner liner 2 in tight support. The inner liner 2 has an expanded annular portion 4 at its outer end so as to tightly touch to the inner surface of the outer tube 1. The tubes 1 and 2 have their inner ends which are terminated at a portion near to a valve seat 5 and connected to each other by means of welding.

The port liner assembly further includes a bore 6 for passing a valve guide sleeve 7 threrethrough. An exhaust valve 8 has a stem 9 slidably inserted into the guide sleeve 7. Such port liner assembly is embedded together with a moulding core (not shown) for forming an exhaust port at a place in a cylinder head block 10 when said block is moulded in a suitable form.

Figure 4:
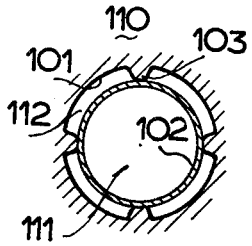
FIG. 4 is a cross-section of the cylinder head block of FIG. 3 along a line of B — B.
Figure 3:
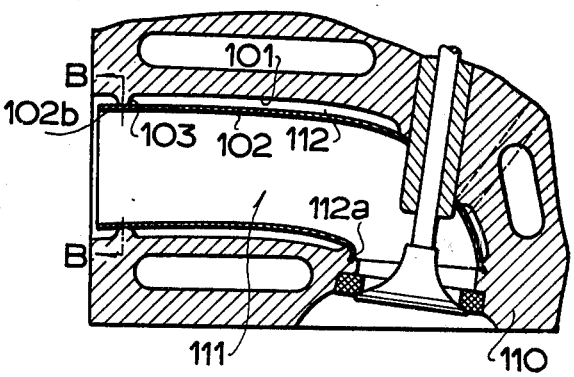
FIG. 3 is a vertical section of a cylinder head block including a port liner assembly of another embodiment.

A port liner 102 illustrated in FIGS. 3 and 4 has its inner end 102*a* fixed to a cylinder head block 110 by the end 102*a* being moulded in the body of the block 110 and its outer end 102*b* tightly touching to beats 103, protruded to the wall of a port bore 111 formed in the block 110, so as to be supported in a floating condition. The tubular liner 102 may be embedded at a place in the cylinder head block 110 together with a moulding core for the port bore 111 and a crumbly layer for forming an outer liner wall 101 and the beats 103 in a manner to form an annular remaining space 112, when the cylinder head block is moulded in a suitable form.

Accordingly, the port liner assemblies in both embodiments can avoid to be thermally deformed, because the outer end of each of the inner floating tubes is slidable to the inner wall of the port bore, and then the air existing in a interval between the floating tube and the wall of the port bore is leakable by parting the outer end of the tube from the wall of the port bore or through a clearance between the former and latter.

Figure 5:
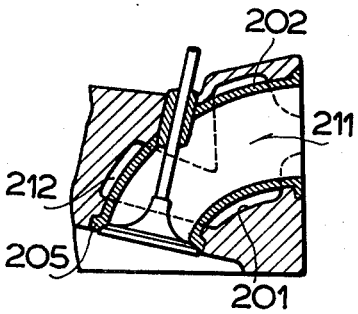
FIG. 5 is a vertical section of a cylinder head block including a port liner assembly from that of FIGS. 3 and 4.

An inner port liner 202 indicated in FIG. 5 is integrally formed with a valve seat 205, and a clearance 212 is formed in a spiral shape between the inner port liner 202 and an outer liner wall 201 included in a port bore 211, in a manner to pass out. Such port liner assembly may be constituted by the same moulding system as that of the second embodiment. In this case, a cylinder head block may be made of aluminum alloy and the port liner 202, of heat resisting metal with a low heat transfer rate.

Figure 6:
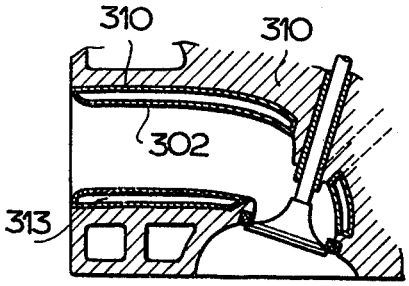
FIG. 6 is a vertical section of a cylinder head block including a port liner assembly of this invention in a fourth embodiment.
Figure 7:
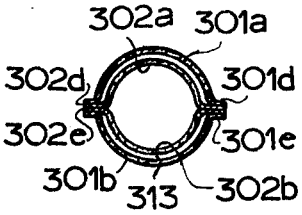
FIG. 7 is a perspective view of said port liner assembly of FIG. 6.
Figure 8:
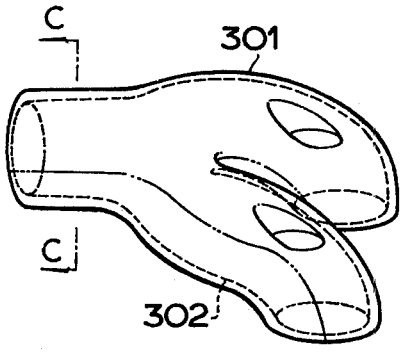
FIG. 8 is a cross-section of the port liner assembly of FIG. 6 along a line C — C of FIG. 7.

FIGS. 6 to 8 indicate a fourth embodiment. A port liner assembly includes an outer liner tube 301 and an inner liner tube 302. The outer tube 301 is formed by two half shells 301*a* and 301*b* with two pairs of flanges 301*d* and 301*e* attached to each other via flanges mentioned hereinafter in the same manner as the first embodiment.

The inner tube 302 consists of two half shells 302*a* and 302*b* with two pairs of flanges 302*d* and 302*e* which are sandwitched by the flanges 301*d* and 301*e*, and integrally fixed to duplicated flanges.

The outer and inner tubes 301 and 302 are formed into a liner body having two separated neck portions corresponding to the exhaust valve of two cylinder bores respectively, and a tail portion gathering said separated portions in a passage.

In a space between the outer and inner tubes 301 and 302 is filled a heat insulation material 313. Instead of the heat insulation material may be filled in the space and burned or reduced to ashes when the liners are embedded in a cylinder head block 310 by casting.

The material filled in the space may be replaced by a material such as obsidian and pearl stone heat-expanded into a porosity. The gasses generated in the porosity remain or escape through pin holes from the space to a sand core to be formed into a exhaust port bore. The pin holes are previously formed to the inner tube.

Figure 9:
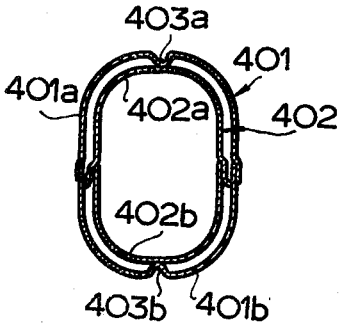
FIG. 9 is a cross-section of a port liner assembly of this invention in a fifth embodiment.
Figure 10:
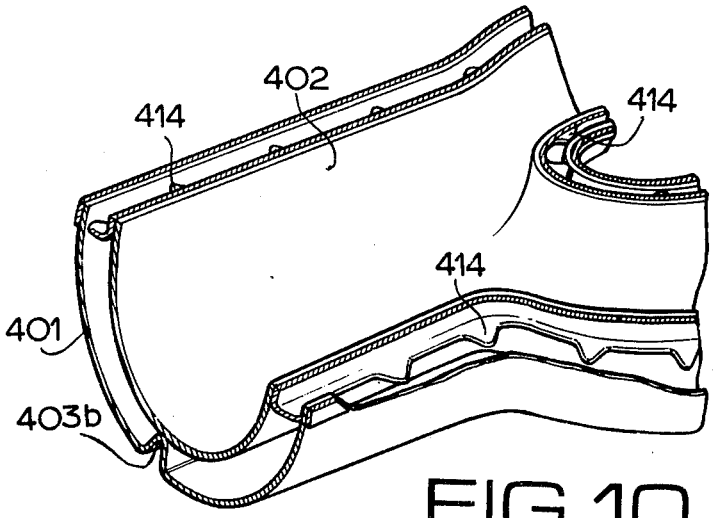
FIG. 10 is a perspective view of said port liner assembly of FIG. 9 partly broken away.

FIGS. 9 and 10 illustrate a fifth embodiment in which a port liner assembly also includes outer and inner tubes 401 and 402 each having two half shells 401*a* and 401*b* (402*a* and 402*b*). The shell 401*a* has two side edges crooked outwards and to which the side edges of the shell 401*b* are engaged from the inside. Both shells 401*a* and 401*b* have beats 402*a* and 403*b* respectively which support the tube 402 at a place of the tube 401. The shell 402 has plurality of protrusions 414 formed to two side edges thereof crooked outwards, and both shells 402*a* and 402*b* are mutually engaged with the protrusions 414 touching to the inner surface of the outer tube 401. Such port liner is assemble in ease, and embedded in the cylinder head block as the latter is moulded.

Figure 11:
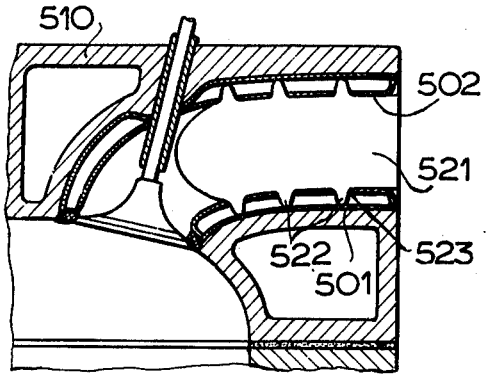
FIG. 11 is a vertical section of a cylinder head block including a port liner assembly of this invention in a sixth embodiment.
Figure 12:
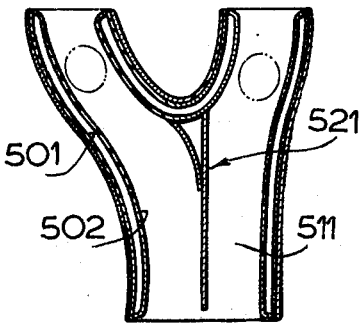
FIG. 12 is a horizontal cross-section of said port liner assembly of FIG. 11.
Figure 13:
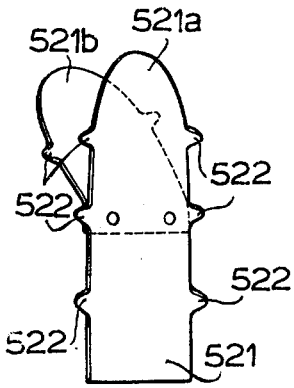
FIG. 13 is a perspective view of an segment included in said port liner assembly of FIG. 11.

FIGS. 11 to 13 indicate port liner assembly having two separated neck portions like to that of the fourth embodiment. Such formed liner assembly has a problem that exhaust gasses supplied from respective cylinder bores through exhaust valves, one of which is only illustrated in FIG. 11, are interfered to each other to reduce engine power and to generate exhaust noises.

To settle the problem, the mentioned port liner assembly has a partition plate 521 having guide portions 521*a* and 521*b* one of which is riveted on the other. The partition plate 521 further has a plurality of protrusions 522 which are inserted into holes 523 formed in an inner tube 502, so as to fix the partition plate 521 to the interior of an exhaust bore 511. The inner tube 502 constitutes a port liner together with an outer tube 501. The port liner is integrally embedded in the port bore 511 when a cylinder head block 510 is moulded.

Accordingly, the partition plate 521 acts to rectify the exhaust gasses and to eliminate wrong effect from the engine operation.

On the second throught, the crumbly layer located to the outer periphery of the port liner 102 of FIGS. 3 and 4 may be, if necessary, made of asbestos or ceramic wool to which sodium silicate solution of 5 to 25 weight percent permeates and which is dried at a temperature of 200° to 400° C.

What is claimed is:

1. A port liner assembly for internal combustion engines having at least one exhaust valve seat, comprising, a cylinder head block, an exhaust port having an inner wall provided in said cylinder head block communicating with at least one exhaust valve seat, a tubular liner provided in said exhaust port comprising an outer tube and an inner tube engaged with each other forming a hollow structure, said tubular liner having means for sliding an outer end of said inner tube relative to said outer tube, said inner tube constituting a floating tube, said inner and outer tubes having inner ends adjacent the exhaust valve seat, and said inner ends being secured together.

2. The port liner, as set forth in claim 1, wherein said outer end of said inner tube forms an expanded annular portion slidably contacting said outer tube.

3. The port liner assembly, as set forth in claim 1, wherein each of said tubes constitutes two half shells, said half shells are mutually welded together.

4. The port liner, as set forth in claim 1, wherein said hollow structure defines a space between said outer and inner tubes, a heat insulation material filling said space.

5. The port liner, as set forth in claim 1, wherein said means is on an outer end of said tubular liner for permitting thermal expansion thereof, the latter constituting a heat insulation means for said inner wall.

6. The port liner, as set forth in claim 2, wherein said means is on an outer end of said tubular liner for permitting thermal expansion thereof, the latter constituting a heat insulation means for said inner wall.

* * * * *